US006511538B1

(12) United States Patent
Wada et al.

(10) Patent No.: US 6,511,538 B1
(45) Date of Patent: Jan. 28, 2003

(54) FILM DEPOSITION METHOD AND APPARATUS FOR SEMICONDUCTOR DEVICES

(75) Inventors: Yuichi Wada, Narita (JP); Hiroyuki Yarita, Narita (JP); Hisashl Aida, Narita (JP); Naomi Yoshida, Narita (JP)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/830,803

(22) PCT Filed: Oct. 29, 1999

(86) PCT No.: PCT/JP99/06036

§ 371 (c)(1),
(2), (4) Date: Apr. 30, 2001

(30) Foreign Application Priority Data

Oct. 29, 1998 (JP) ..... 10-308674

(51) Int. Cl.[7] ..... C30B 25/04

(52) U.S. Cl. ..... 117/95; 117/104; 118/723 EP; 118/723 E; 427/570; 427/576; 427/580

(58) Field of Search ..... 118/719, 723 VE, 118/723 EP, 723 E; 427/570, 576, 580; 117/95, 104

(56) References Cited

U.S. PATENT DOCUMENTS 6,541,858 * 6/2001 Phillipd et al. ..... 204/192.15

FOREIGN PATENT DOCUMENTS

| | | |
|---|---|---|
| JP | 3-157658 | 7/1991 |
| JP | 4-53132 | 2/1992 |
| JP | 5-160018 | 6/1993 |
| JP | 11-1778 | 1/1999 |

* cited by examiner

*Primary Examiner*—Felisa Hiteshew
(74) *Attorney, Agent, or Firm*—Moser, Patterson & Sheridan

(57) ABSTRACT

When performing film deposition on the surface of a wafer, a turntable supporting the wafer is first rotated. Next, a fluid containing an organic metal is applied onto the wafer via the tip of a nozzle. At the same time, an ultrasound wave is generated by an ultrasound wave generating device, and the turntable is vibrated. Thus the vibrations from the turntable are applied to the wafer, these wafer vibrations allow the fluid containing an organic metal to thoroughly permeate into the detailed patterning of the wafer surface, and said fluid covers its entirety. As a result, film deposition with excellent filling-in characteristics becomes possible.

24 Claims, 3 Drawing Sheets

FILM DEPOSITION METHOD AND APPARATUS FOR SEMICONDUCTOR DEVICES

This application is a 371 of PCT JP99/06036 Oct. 29, 1999.

TECHNICAL FIELD

The present invention relates to a film deposition method and apparatus in, for example, fabrication processes of semiconductor devices, which perform film deposition utilizing fluid such as an organic metal on a to-be-processed body, such as a wafer that is placed in a process chamber.

BACKGROUND ART

In recent years, in the field of semiconductor device manufacturing, the demand for increased integration and miniaturization of semiconductor devices has become stronger, and in order to respond to those demands, there has been a considerable shift from using aluminum as the interconnect material in film deposition processes to using copper.

Such types of film deposition apparatus, which performs film deposition using material that includes copper to form a thin film using a pyrolytic decomposition reaction, while heating a wafer located in the process chamber, for example, and applying on this wafer an organic metal (that is usually in its fluid state at room temperature and under normal pressure) such as (hfac)$Cu^{+1}$(tmvs), or a mixture of an organic solvent with this organic metal (hereafter called 'fluid containing an organic metal'), is well known.

However, in accordance with the further miniaturization of semiconductor devices, it is difficult for the organic metal to thoroughly permeate into holes or trenches such as contact holes that are microstructured on the wafer by only applying an organometallic fluid as mentioned above. As a result, vacancies develop within the detailed patterning, and filling-in characteristics worsen.

The present invention aims to provide a film deposition method and apparatus, which make it possible for a fluid to thoroughly permeate into holes or trenches that are microstructured on a to-be-processed body and deposit a film with excellent filling-in characteristics.

DISCLOSURE OF THE INVENTION

In order to fulfill the objective mentioned above, according to one aspect of the present invention, a film deposition method including a procedure for adhering a fluid on a to-be-processed body located within a process chamber, is characterized by generating vibrations on the to-be-processed body to which fluid is adhered and/or the fluid.

By when fluid is adhered to the the surface of a to-be-processed body in this manner, and a vibration added to it, it is possible for said fluid to thoroughly permeate into the holes and trenches microstructured on the to-be-processed body at this time. Accordingly, almost no vacancies exist within the detailed patterning, and filling-in characteristics improve.

In the film deposition method mentioned above, it is preferable that vibrations are generated by ultrasound waves.

Also, deposition of a metal film may be performed by causing a pyrolytic decomposition reaction utilizing a fluid that includes an organic metal. It is preferable that a mixture of an organic metal and organic solvent is used as the organometallic fluid. In this case, a copper-ketonato metal complex is used as the organic metal, and by using an aliphatic saturated hydrocarbon as the organic solvent, the deposition of a copper film may be performed.

Also, according to another aspect of the present invention, a film deposition apparatus, which performs film deposition by adhering a fluid containing an organic metal onto a to-be-processed body located within the process chamber and causing a pyrolytic decomposition reaction, is characterized by comprising supporting means, which supports the to-be-processed body located within the process chamber; fluid adhering means, which adheres the fluid onto the surface of the to-be-processed body; and vibration generating means, which generates vibrations on either the to-be-processed body that is supported by the supporting means, or the fluid, or both.

By providing such supporting means, fluid adhering means and vibration generating means, the film deposition method mentioned above may be executed. As a result, the fluid thoroughly permeates, for example, into the holes that are microstructured on the to-be-processed body, and filling-in characteristics improve.

It is preferable that the vibration generating means of the film deposition apparatus mentioned above, comprise an ultrasound wave generating means connected to the supporting means. As a result, the vibrations from the ultrasound waves are applied to the to-be-processed body via the supporting means, generating a vibration on this to-be-processed body.

In addition, the supporting means may be a turntable that supports a to-be-processed body on its top surface. In this case, it is preferable that the fluid adhering means comprise a nozzle, which drips the fluid onto the surface of the to-be-processed body, wherein the tip is capable of moving horizontally above the turntable.

Moreover, in the film deposition apparatus mentioned above, the fluid. adhering means may comprise a fluid reservoir for storing the fluid containing an organic metal, and the vibration generating means may comprise an ultrasound wave generating means connected to the fluid reservoir. As a result, when the surface of the to-be-processed body supported by the supporting means is soaked in the organometallic fluid that is stored in the fluid reservoir, the vibrations from the ultrasound waves are applied to the organometallic fluid stored in the fluid reservoir, to cause vibration of said fluid.

In this case, it is preferable that the supporting means be a turntable, which can move upward and downward, supporting the to-be-processed body on its bottom surface.

BEST MODE FOR CARRYING OUT THE INVENTION

In the following, the preferred embodiments according to the present invention will be described in detail while referencing the Figures.

Figure 1:
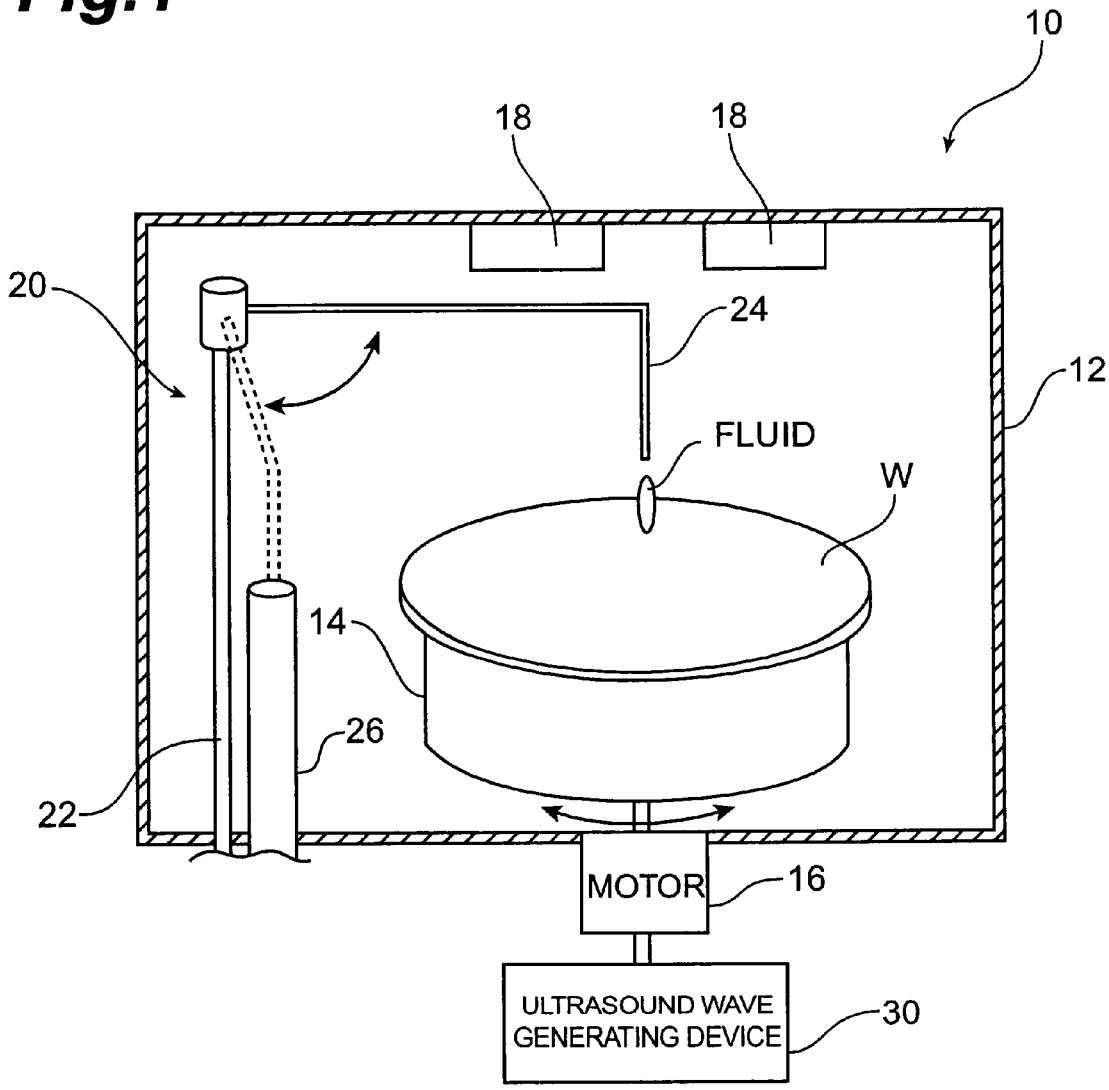
FIG. 1 is a schematic diagram showing the first embodiment of a film deposition apparatus according to the present invention.

FIG. 1 is a schematic diagram showing the first embodiment of a film deposition apparatus according to the present invention. In FIG. 1, film deposition apparatus 10 is provided with process chamber 12, wherein turntable (supporting means) 14 is located within this process chamber 12 supporting semiconductor wafer (to-be-processed body) W. This turntable 14 supports wafer W above it with appropriate means such as a vacuum chuck, and has a ring-shaped clamping component not shown in the Figure that clamps to the rim of wafer W. This kind of clamping component is provided in consideration of the possibility of defects, such as particalization, developing if film deposition is performed on the rim of wafer W. Turntable 14 is rotationally driven by driving motor 16. Also placed within process chamber 12, there is a plurality of heating lamps 18 for heating wafer W placed on top of turntable 14.

In addition, fluid adhering device 20 is provided within process chamber 12 for adhering an organometallic fluid on to the surface of wafer W. Here, a mixture of $(hfac)Cu^{+1}$ (tmvs), which is an organic metal, and an organic solvent (in this case, heptadecane) is used as the organometallic fluid.

Fluid adhering device 20, which is connected to a tank not shown in the Figure that stores a fluid containing such manner of organic solvent, comprises supply pipeline 22, which extends vertically; and nozzle 24, which extends horizontally from the upper end of this supply pipeline 22 with its tip pointing downwards. And the fluid containing an organic metal stored in the tank is sent via supply pipeline 22 to nozzle 24, which is then discharged from it stip. Also, it is possible for supply pipeline 22 to be rotationally driven by a driving motor not shown in the Figure. As a result, the tip of nozzle 24 becomes rotatable about the center axis of supply pipeline 22 located above turntable 14. It is noted here that component 26 is a drainpipe provided directly beneath the fixed position of the vertically-moving route of the tip of nozzle 24, wherein the fluid dripped from nozzle 24 is collected by drainpipe 26, making it reusable.

Ultrasound wave generating device (vibration generating means) 30 is integrally connected to the output axis of driving motor 16. This ultrasound wave generating device 30 comprises an oscillator, which generates high-frequency wave signals; and an ultrasonic resonator, which generates ultrasound waves of a fixed frequency from input high-frequency wave signals of this oscillator, not shown in the Figure. The vibrations resulting from these ultrasound waves are applied to turntable 14 via the output axis of driving motor 16, causing turntable 14 to vibrate. It is noted here that the connected positioning of ultrasound wave generating device 30 is not particularly limited to the output axis of driving motor 16 as mentioned above, and may be placed anywhere as long as it is in a position that allows turntable 14 to be vibrated without occuring any particle while turntable 14 is rotating.

According to this embodiment, which is structured in the manner described above, when film deposition is performed on the surface of wafer W that is placed on turntable 14, turntable 14 is first rotated by driving motor 16, while heating lamps 18 are still off. Then, once the fluid containing an organic metal is poured out of the tip of nozzle 24, said fluid radiates outward spreading across wafer W due to the centrifugal force, and is evenly applied over the entire surface, except for the area that is clamped with the previously mentioned ring-shaped clamping component (not shown in the Figure). At the same time, ultrasound waves are generated by ultrasound wave generating device 30 to vibrate turntable 14. The vibration from turntable 14 is applied to wafer W, and this vibration of wafer W thus allows the fluid containing an organic metal to thoroughly permeate into the holes and trenches, such as the contact holes that are microstructured on the surface of wafer W. As a result, said fluid covers the entire detailed patterning.

Figure 2:
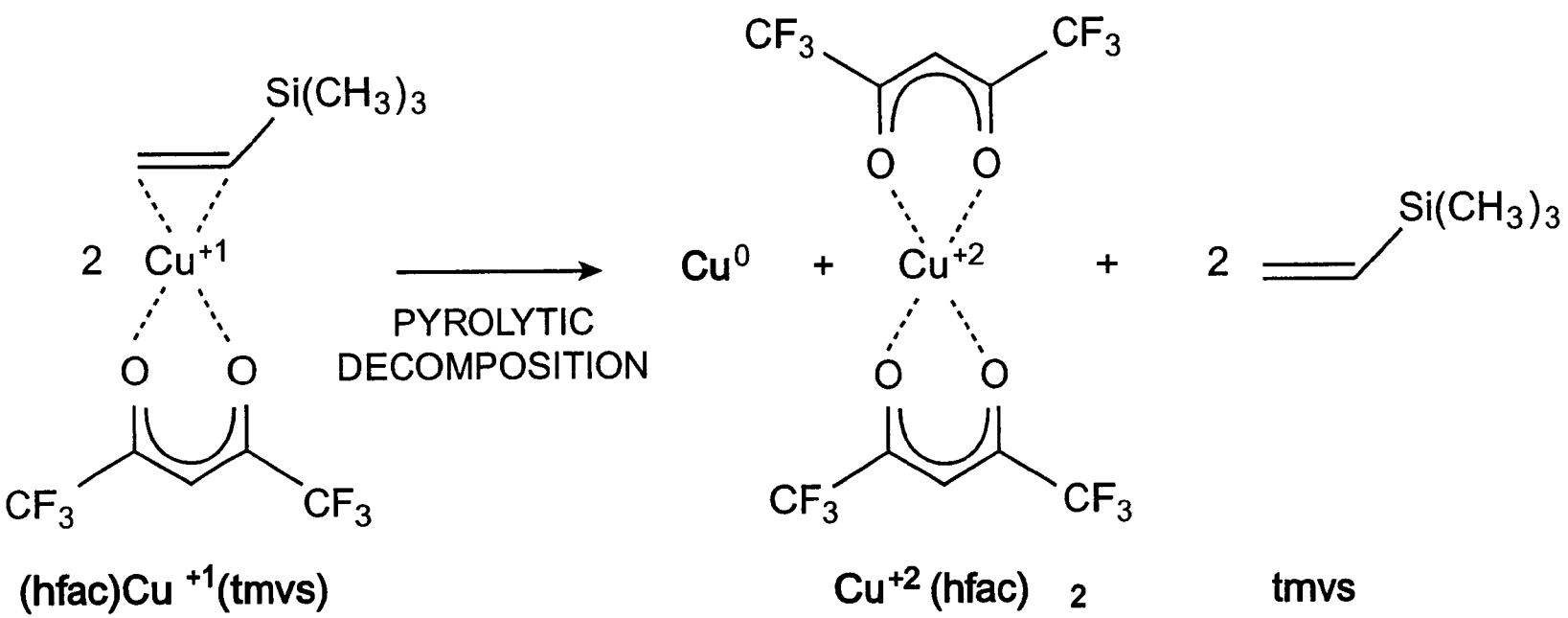
FIG. 2 shows the chemical reaction formula at the time of the pyrolytic decomposition reaction of (hfac)$Cu^{-1}$(tmvs)

Afterwards, heating lamps 18 are turned on, to heat the fluid containing an organic metal applied onto wafer W. As a result, a pyrolytic decomposition reaction of the $(hfac)Cu^{-1}(tmvs)$ within said fluid occurs, copper precipitates on the surface of wafer W, and a thin film is formed. The pyrolytic decomposition reaction of $(hfac)Cu^{-1}(tmvs)$ is shown in FIG. 2.

The $Cu^{+2}(hfac)_2$ and tmvs formed from this reaction are vaporized by the temperature within process chamber 12 during the pyrolytic decomposition reaction, and are evacuated from process chamber 12 by an exhaust pump not shown in the Figure. Heptadecane, which is an organic solvent, is also vaporized by heat and evacuated, so that none is left remaining on wafer W.

In the present embodiment as described above, since wafer W is vibrated via turntable 14, the fluid containing an organic metal thoroughly permeates into the detailed patterning of the surface of wafer W, almost no vacancies exist, and as a result, filling-in characteristics improve.

It is noted here that in the present embodiment, the application of the fluid containing an organic metal onto wafer W, and the vibrating of turntable 14 is simultaneous; however, turntable 14 may also be vibrated after the fluid containing an organic metal is applied onto wafer W. Turntable 14 may also be vibrated at the same time it is being rotated.

Furthermore, in this embodiment, turntable 14 is vibrated as described above, however, it is also allowable for wafer W itself to be vibrated.

Figure 3:
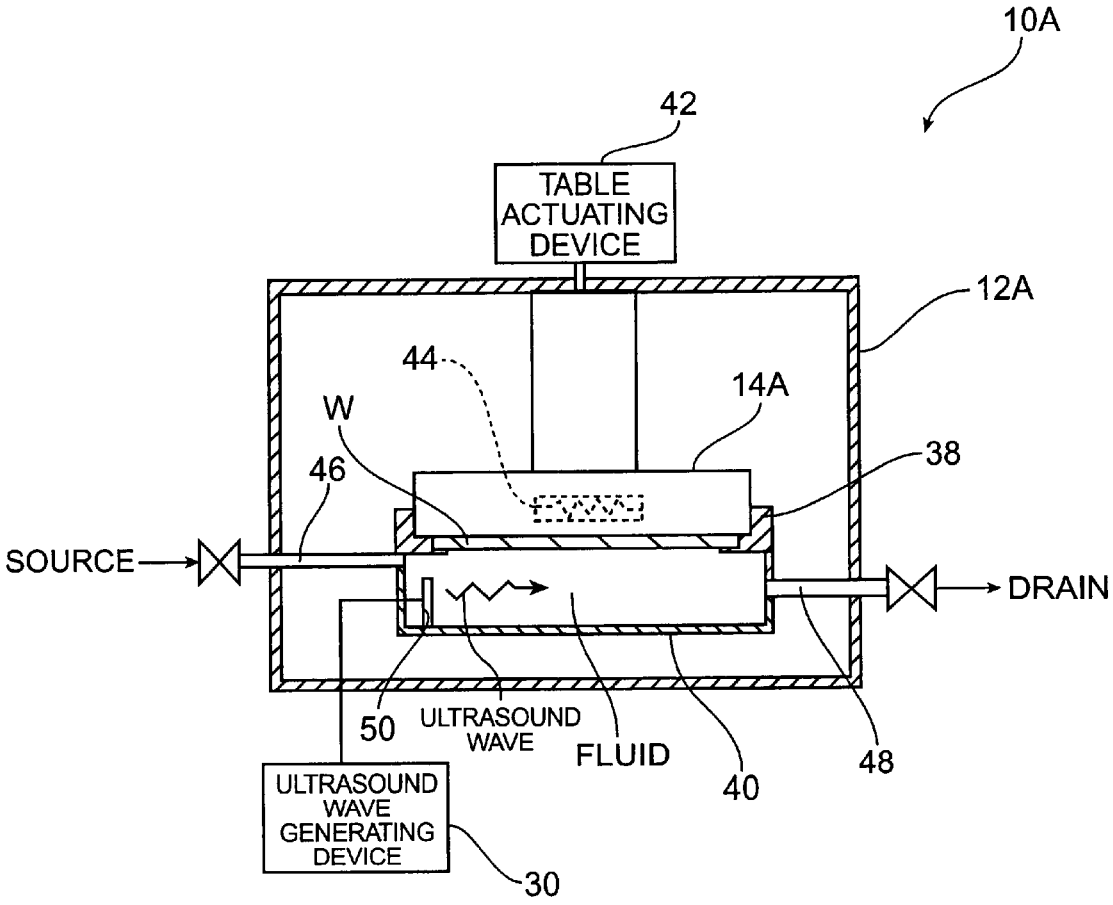
FIG. 3 is a schematic diagram showing the second embodiment of a film deposition apparatus according to the present invention.

FIG. 3 is a schematic diagram showing the second embodiment of a film deposition apparatus according to the present invention. In this Figure, film deposition apparatus 10A is provided with process chamber 12A, wherein turntable 14A, which supports the wafer, and fluid reservoir (fluid adhering means) 40, which stores the fluid containing the organic metal mentioned above are provided.

Turntable 14A is an object that supports wafer W with an appropriate means such as a vacuum chuck on its bottom surface, and has ring-shaped clamping component 38 that clamps to the rim of wafer W. Also, turntable 14A can be rotationally driven and move upward and downward by table actuating device 42. At this time, it is possible for turntable 14A to drop down to the position where wafer W is supported beneath it and is soaked in the fluid containing an organic metal stored within fluid reservoir 40. In addition, turntable 14A is provided with heater 44 for heating wafer W, which is supported on the bottom surface of turntable 14.

Supply pipeline 46 for supplying the fluid containing an organic metal, and evacuation pipeline 48 for evacuating said fluid, are connected to fluid reservoir 40, wherein it is easy to perform, for example, the exchange of the fluid containing an organic metal via these pipelines 46 and 48.

Also, vibrating plate 50, which configures a portion of the vibration generating means, is located within fluid reservoir 40. The above-mentioned ultrasound wave generating device 30 is integrally connected to this vibrating plate 50. When ultrasound waves are generated by ultrasound wave generating device 30, the vibrations from these ultrasound waves are applied to vibrating plate 50, and the fluid containing an organic metal within fluid reservoir 40 is vibrated.

In the case where film deposition is performed, according to this embodiment structured as described above, on the surface of wafer W, which is supported by the bottom surface of turntable 14A, as table actuating device 42 begins to rotate turntable 14A while heater 44 is off, turntable 14A is lowered to a position that allows wafer W to be soaked in the fluid containing an organic metal stored within fluid reservoir 40. Ultrasound waves are then generated by ultrasound wave generating device 30, vibrating the fluid containing an organic metal within fluid reservoir 40 via vibrating plate 50. This vibration allows the fluid containing an organic metal to thoroughly permeate the detailed patterning of the surface of wafer W, and said fluid covers the entirety. Afterwards, by using table actuating device 42 to raise turntable 14A, and by using heater 44 to heat the fluid containing an organic metal in which the surface of wafer W is soaked, a pyrolytic decomposition reaction occurs on said fluid, to form a thin film on wafer W.

In the above manner with this embodiment, the fluid containing an organic metal that is in fluid reservoir 40 has been vibrated, thus in the same manner as in the first embodiment, almost no vacancies develop within the detailed patterning of the surface of wafer W, and filling-in characteristics improve.

It is noted here that in this embodiment, the fluid containing an organic metal within fluid reservoir 40 is vibrated; however, it is also allowable for turntable 14A to be vibrated, and wafer W itself may even be vibrated.

In the above, two preferred embodiments of the present invention are described; however, it goes without saying that the present invention is not limited to the above embodiments. In the above embodiment, for example, vibrations are generated by an ultrasound wave; however, means for generating the vibrations is not specifically limited to ultrasound waves, but may be, for example, an electromagnet or a piezoelectric element in which a high-frequency electric current is supplied, resulting in the generation of vibrations.

Furthermore, a turntable is used as supporting means for supporting wafer W; however the supporting means is not limited to a turntable, and may even be of a fixed model that does not rotate.

Furthermore, the fluid containing an organic metal is a fluid resulting from mixing $(hfac)Cu^{+1}(tmvs)$, which is a copper-ketonato metal complex, with heptadecane, which is an aliphatic saturated hydrocarbon; however, the organic metal is not especially limited to $(hfac)Cu^{-1}(tmvs)$. For example, in the case of depositing a copper film, another copper-ketonato metal complex such as $(hfac)Cu^{-1}(teovs)$ may be used. In addition, in the case of performing film deposition on another material, another organic metal besides a copper-ketonato metal complex may be used.

Furthermore, as an organic solvent for the copper-ketonato metal complex, another aliphatic saturated hydrocarbon besides pentadecane, hexadecane, or octadecane may be used, not especially limiting to the above-mentioned heptadecane. As an organic metal for the copper-ketonato metal complex, another solvent may be used. Moreover, the organic metal itself may be used as the fluid containing an organic metal.

Furthermore, the present invention can be applied to other film deposition processes that include procedures for adhering a fluid onto a to-be-processed body that is placed inside the process chamber.

Industrial Applicability

According to the present invention, when a fluid such as an organic metal is used for film deposition, since the fluid is able to thoroughly permeate into holes and trenches, such as the contact holes that are microstructured on the to-be-processed body, film deposition with excellent filling-in characteristics becomes possible.

As a result, within manufacturing fields such as semiconductor devices, it is possible to accommodate improvements in integration and further miniaturization of the device.

What is claimed is:

1. A film deposition method, which includes a procedure for adhering a fluid on a body located within a process chamber; wherein vibrations are generated on said body whereto said fluid is adhered or on said fluid.

2. The film deposition method according to claim 1, wherein said vibrations are generated by an ultrasound wave.

3. The film deposition method according to claim 1, wherein a substance containing an organic metal is used as said fluid, and film deposition is performed by causing a pyrolytic decomposition reaction on this fluid containing an organic metal.

4. The film deposition method according to claim 3, wherein a mixture of said organic metal and an organic solvent is used as said fluid containing an organic metal.

5. The film deposition method according to claim 4, wherein a copper-ketonato metal complex is used as said organic metal, and an aliphatic saturated hydrocarbon is used as said organic solvent.

6. The film deposition method according to claim 5, wherein said body comprises of a semiconductor wafer.

7. The film deposition method according to claim 1, wherein said body comprises of a semiconductor wafer.

8. A film deposition apparatus, which performs film deposition after adhering a fluid onto a body located within a process chamber; said film deposition apparatus comprising:

a supporting means, which supports said body located within said process chamber;

a fluid adhering means, which adheres said fluid onto the surface of said body; and a vibration generating means, which generates vibrations on said body supported by said supporting means, or on said fluid.

9. The film deposition apparatus according to claim 8, wherein said vibration generating means comprises ultrasound wave generating means, which is connected to said supporting means.

10. The film deposition apparatus according to claim 8, wherein said supporting means is a turntable, which supports said body on its upper surface.

11. The film deposition apparatus according to claim 10, herein said fluid adhering means comprises a nozzle, which drips said fluid containing an organic metal onto the surface of said body; wherein the tip of said nozzle is capable of moving horizontally above said turntable.

12. The film deposition apparatus according to claim 8, wherein said fluid adhering means comprises a fluid reservoir for storing said fluid, and said vibration generating means comprises an ultrasound wave generating means connected to said fluid reservoir.

13. The film deposition apparatus according to claim 12, wherein said supporting means is a turntable, which can move upwards and downwards, supporting said body with its lower surface.

14. The film deposition apparatus according to claim 8, wherein said fluid contains an organic metal, and film deposition is performed by causing a pyrolytic decomposition reaction on this fluid containing an organic metal.

15. The film deposition apparatus according to claim 14, wherein said body comprises of a semiconductor wafer.

16. The film deposition apparatus according to claim 8, wherein said body comprises of a semiconductor wafer.

17. A method for adhering a fluid to a body surface located within a process chamber comprising:

applying a fluid to the body surface and vibrating the applied fluid.

18. The method of claim 17, wherein the body surface includes a surface of holes and trenches.

19. The method of claim 18, wherein the vibration is sufficient to permeate the surface of holes and trenches on the body surface with the applied fluid.

20. The method of claim 19, wherein the vibration is generated by an ultrasound wave.

21. The method of claim 19, wherein a substance containing an organic metal is used as the applied fluid.

22. The method of claim 21, wherein a film deposition is performed by causing a pyrolytic decomposition of the applied fluid.

23. The method of claim 21, wherein a mixture of the organic metal and an organic solvent is used as the applied fluid containing the organic metal.

24. The method of claim 23, wherein a copper-ketonato metal complex is used as the organic metal and an aliphatic saturated hydrocarbon is used as the organic solvent.

* * * * *

UNITED STATES PATENT AND TRADEMARK OFFICE

CERTIFICATE OF CORRECTION

PATENT NO. : 6,511,538 B1
DATED : January 28, 2003
INVENTOR(S) : Yuichi Wada et al.

It is certified that error appears in the above-identified patent and that said Letters Patent is hereby corrected as shown below:

Title page,
Item [75], Inventors, please change "Hisashl" to -- Hisashi --.

Column 3,
Line 29, please change "it stip." to -- its tip --.

Signed and Sealed this

Ninth Day of September, 2003

JAMES E. ROGAN
*Director of the United States Patent and Trademark Office*